US010323563B2

(12) United States Patent
Zermeño Benitez et al.

(10) Patent No.: US 10,323,563 B2
(45) Date of Patent: Jun. 18, 2019

(54) OPEN EXHAUST CHAMBER CONSTRUCTIONS FOR OPPOSED-PISTON ENGINES

(71) Applicant: ACHATES POWER, INC., San Diego, CA (US)

(72) Inventors: Rodrigo Zermeño Benitez, San Diego, CA (US); Brian J. Callahan, San Diego, CA (US); Kevin B. Fuqua, San Marcos, CA (US); Christopher J. Kalebjian, Columbus, MI (US)

(73) Assignee: ACHATES POWER, INC., San Diego, CA (US)

( * ) Notice: Subject to any disclaimer, the term of this patent is extended or adjusted under 35 U.S.C. 154(b) by 432 days.

(21) Appl. No.: 15/145,705

(22) Filed: May 3, 2016

(65) Prior Publication Data

US 2017/0321591 A1 Nov. 9, 2017

(51) Int. Cl.

| | |
|---|---|
| ***F01N 13/10*** | (2010.01) |
| ***F02B 25/08*** | (2006.01) |
| ***F02B 75/28*** | (2006.01) |
| ***F02B 27/04*** | (2006.01) |
| ***F01B 7/14*** | (2006.01) |

(52) U.S. Cl.

CPC ..... *F01N 13/10* (2013.01); *F01B 7/14* (2013.01); *F02B 25/08* (2013.01); *F02B 75/28* (2013.01); *F02B 75/282* (2013.01); *F01N 2260/06* (2013.01); *F02B 27/04* (2013.01)

(58) Field of Classification Search

CPC .. F01B 7/14; F02B 27/04; F02B 75/28; F02B 75/282; F01N 2260/06; F01N 13/10

USPC ..... 60/320–324

See application file for complete search history.

(56) References Cited

U.S. PATENT DOCUMENTS

| | | | | |
|---|---|---|---|---|
| 1,517,634 | A | 12/1924 | Junkers | 60/321 |
| 2,129,172 | A | 9/1938 | Gehrandt | 123/51 B |

(Continued)

FOREIGN PATENT DOCUMENTS

| | | | |
|---|---|---|---|
| GB | 558115 | A | 12/1943 |
| WO | WO-2015/179116 | A1 | 11/2015 |
| WO | WO-2015/179117 | A1 | 11/2015 |

OTHER PUBLICATIONS

Modernizing the Opposed Piston, Two Stroke Diesel Engine—Achates Power 2012.*

(Continued)

*Primary Examiner* — Jason D Shanske
*Assistant Examiner* — Jessica L Kebea
(74) *Attorney, Agent, or Firm* — Terrance A. Meador; Julie J. Muyco

(57) ABSTRACT

A configuration for a uniflow-scavenged, opposed-piston engine reduces exhaust cross-talk caused by mass flow between cylinders resulting from one cylinder having an open exhaust port during scavenging and/or charging while an adjacent cylinder is undergoing blowdown. Some configurations include a wall or other barrier feature between cylinders that are adjacent to each other and fire one after the other. Additionally, or alternatively, some engine configurations include cylinders with intake and exhaust ports sized so that there is an overlap in crank angle of two or more cylinders having open exhaust ports of about 65 crank angle degrees or less.

12 Claims, 9 Drawing Sheets

(56) References Cited

U.S. PATENT DOCUMENTS

| | | | | | |
|---|---|---|---|---|---|
| 2,233,499 | A | * | 3/1941 | Todd | F01B 7/14 123/195 A |
| 2,611,349 | A | | 9/1952 | Parrish | 123/51 B |
| 2,776,649 | A | * | 1/1957 | Fenske | F02B 75/26 123/43 A |
| 2,827,027 | A | * | 3/1958 | Smith | F02B 33/42 123/58.7 |
| 3,007,462 | A | * | 11/1961 | Balzer | F02B 75/26 123/51 B |
| 4,732,115 | A | | 3/1988 | Lapeyre | 123/51 B |
| 4,905,637 | A | * | 3/1990 | Ott | F01B 3/0026 123/196 R |
| 9,551,220 | B2 | | 1/2017 | Fuqua et al. | F01B 7/14 |
| 9,581,024 | B2 | | 2/2017 | Fuqua et al. | F01B 7/14 |
| 2007/0107707 | A1 | | 5/2007 | Spieth et al. | 123/568.17 |
| 2016/0032823 | A1 | | 2/2016 | McClearen et al. | 123/51 B |
| 2016/0032824 | A1 | | 2/2016 | Fuqua | F02B 75/282 |
| 2016/0290277 | A1 | | 10/2016 | Koszewnik et al. | 123/51 R |

OTHER PUBLICATIONS

International Search Report and Written Opinion dated Aug. 18, 2017, for PCT application No. PCT/US2017/029457.

*Ortho-McNeil Pharmaceutical, Incorporated* v. *Caraco Pharmaceutical Laboratories, Limited*, 476 F.3d 1321 (2007).

* cited by examiner

OPEN EXHAUST CHAMBER CONSTRUCTIONS FOR OPPOSED-PISTON ENGINES

GOVERNMENT LICENSE RIGHTS

This invention was made with government support under NAMC Project Agreement No. 69-201502 awarded by the NATIONAL ADVANCED MOBILITY CONSORTIUM (NAMC), INC. The government has certain rights in the invention.

CROSS-REFERENCE TO RELATED APPLICATIONS

This application contains subject matter related to that of commonly-owned U.S. patent application Ser. No. 14/450,808, filed Aug. 4, 2014, "Exhaust Layout With Accompanying Firing Sequence For Two-Stroke Cycle, Inline, Opposed-Piston Engines," now U.S. Pat. No. 10,001,057 issued on Jun. 19, 2018; Ser. No. 14/284,058, filed May 21, 2014, "Air Handling Constructions for Opposed-Piston Engines," now U.S. Pat. No. 9,581,024 issued on Feb. 28, 2017; and Ser. No. 14/284,134, filed May 21, 2014, "Open Intake and Exhaust Chamber Constructions for an Air Handling System of an Opposed-Piston Engine," now U.S. Pat. No. 9,551,220 issued on Jan. 24, 2017.

FIELD

The field concerns a two-stroke cycle, uniflow-scavenged, opposed-piston engine. The cylinders of the engine are arranged inline in a cylinder block. The cylinder block includes an open exhaust chamber. All exhaust ports of the cylinders are positioned in the exhaust chamber.

BACKGROUND

A two-stroke cycle engine is an internal combustion engine that completes a cycle of operation with a single complete rotation of a crankshaft and two strokes of a piston connected to the crankshaft. The strokes are typically denoted as compression and power strokes. One example of a two-stroke cycle engine is an opposed-piston engine in which two pistons are disposed in the bore of a cylinder for reciprocating movement in opposing directions along the central axis of the cylinder. Each piston moves between a bottom dead center (BDC) location where it is nearest one end of the cylinder and a top dead center (TDC) location where it is furthest from the one end. The cylinder has ports formed in the cylinder sidewall near respective BDC piston locations. Each of the opposed pistons controls one of the ports, opening the port as it moves to its BDC location, and closing the port as it moves from BDC toward its TDC location. One of the ports serves to admit charge air into the bore, the other provides passage for the products of combustion out of the bore; these are respectively termed "intake" and "exhaust" ports (in some descriptions, intake ports are referred to as "air" ports or "scavenge" ports). In a uniflow-scavenged opposed-piston engine, pressurized charge air enters a cylinder through its intake port as exhaust gas flows out of its exhaust port, thus gas flows through the cylinder in a single direction ("uniflow") along the length of the cylinder, from intake port to exhaust port.

Charge air and exhaust products flow through the cylinder via an air handling system (also called a "gas exchange" system). Fuel is delivered by injection from a fuel delivery system. As the engine cycles, a control mechanization governs combustion by operating the air handling and fuel delivery systems in response to engine operating conditions. The air handling system may be equipped with an exhaust gas recirculation ("EGR") system to reduce production of undesirable compounds during combustion.

In an opposed-piston engine, the air handling system moves fresh air into and transports combustion gases (exhaust) out of the engine, which requires pumping work. The pumping work may be done by a gas-turbine driven pump, such as a compressor (e.g., a turbocharger), and/or by a mechanically-driven pump, such as a supercharger. In some instances, the compressor unit of a turbocharger may be located upstream or downstream of a supercharger in a two-stage pumping configuration. The pumping arrangement (single stage, two-stage, or otherwise) can drive the scavenging process, which is critical to ensuring effective combustion, increasing the engine's indicated thermal efficiency, and extending the lives of engine components such as pistons, rings, and cylinders. Additionally, pressure and suction waves in the intake and exhaust can also provide pumping work. The pumping work also drives an exhaust gas recirculation system.

Opposed-piston engines have included various constructions designed to transport engine gasses (charge air, exhaust) into and out of the cylinders. For example, U.S. Pat. No. 1,517,634 describes an early opposed-piston aircraft engine that made use of a multi-pipe exhaust manifold having a pipe in communication with the exhaust area of each cylinder that merged with the pipes of the other cylinders into one exhaust pipe. The manifold was mounted to one side of the engine.

In the 1930s, the Jumo 205 family of opposed-piston aircraft engines defined a basic air handling architecture for dual-crankshaft opposed-piston engines. The Jumo engine included an inline cylinder block with six cylinders. The construction of the cylinder block included individual compartments for exhaust and intake ports. Manifolds and conduits constructed to serve the individualized ports were attached to or formed on the cylinder block. Thus, the engine was equipped with multi-pipe exhaust manifolds that bolted to opposite sides of the engine so as to place a respective pair of opposing pipes in communication with the annular exhaust area of each cylinder. The output pipe of each exhaust manifold was connected to a respective one of two entries to a turbine. The engine was also equipped with intake conduits located on opposing sides of the engine that channeled charge air to the individual intake areas of the cylinders. A two-stage pressure charging system provided pressurized charge air for the intake conduits.

The prior art exhaust manifolds extracted a penalty in increased engine size and weight. Each individual pipe required structural support in order to closely couple the pipe opening with the annular exhaust space of a cylinder. Typically, the support was in the form of a flange at the end of each pipe with an area sufficient to receive threaded fasteners for sealably fastening the flange to a corresponding area on a side of the cylinder block. The flanges of each manifold were arranged row-wise in order to match the inline arrangement of the cylinders. The width of the ducts connected to these flanges restricted cylinder-to-cylinder spacing, which required the engine to be comparatively heavy and large.

SUMMARY

In modern vehicle engines, weight and improved performance, both in terms of power and emissions, are factors that are balanced in designing engine components. The design of the space in an engine that receives exhaust from the cylinders after each combustion event can reduce weight and improve performance. The engines described herein have an open exhaust plenum (also called an exhaust chest) which receives exhaust from all of the cylinders in the engine in place of the exhaust manifold described above. In some instances in an open exhaust plenum, the pressure pulses caused by exhaust gas during blow down may result in cross-talk between open exhaust ports of adjacent cylinders as they operate. Such exhaust cross-talk is characterized by bursts, waves, or pulses of pressure moving through exhaust gas ("backpulses") and emanating from the exhaust port of one cylinder undergoing blow-down, which, when reaching the exhaust port of an adjacent cylinder undergoing scavenging or charging, may cause reduction in mass flow rate, or a negative mass flow rate, of gas through the intake port of the adjacent cylinder. The engine constructions described herein include features that reduce exhaust cross-talk and optimize performance based upon the number and nature of the cylinders in the engine.

Provided in some implementations is an open exhaust plenum construction for an opposed-piston engine that includes a wall or other obstructing feature between adjacent cylinders that consecutively undergo blowdown.

In a related aspect, some implementations provide a uniflow-scavenged, opposed-piston engine having cylinders with intake and exhaust ports longitudinally displaced along the length of each cylinder and an exhaust chest that receives the exhaust from all of the cylinders in the engine in which two or more cylinders simultaneously have open exhaust ports, wherein these ports are open for periods that overlap by 65 degrees of crank angle or less.

BRIEF DESCRIPTION OF THE DRAWINGS

In the figures.

DETAILED DESCRIPTION OF THE PREFERRED EMBODIMENTS

Figure 1:
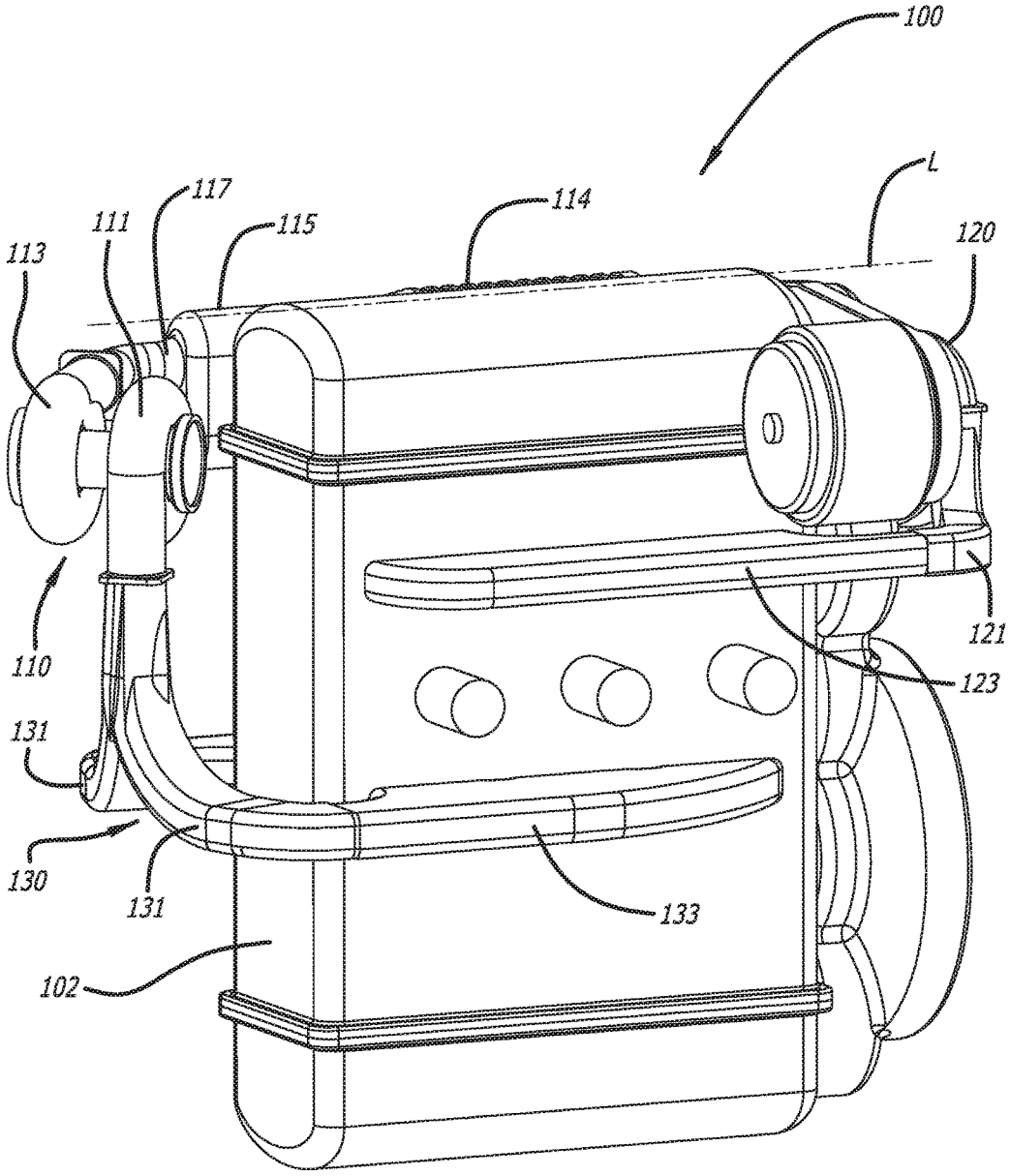
FIG. 1 is an exemplary opposed-piston engine.

FIG. 1 shows a two-stroke-cycle, opposed-piston engine 100 having a cylinder block 102 comprising the cylinders (shown in FIG. 2 and described in greater detail below) of the engine, which are arranged in a straight inline configuration oriented in a longitudinal direction L of the engine 100. The engine is configured to be compact so as to occupy minimal space in applications such as vehicles, locomotives, maritime vessels, stationary power sources, and so on. The engine 100 is fitted with an air handling system including a turbocharger 110, a supercharger 114, intake and exhaust chambers (unseen in this figure, exhaust chamber is shown in FIG. 3A) formed or machined in the cylinder block 102, and various pipes, manifolds, and conduits. With the exception of the intake and exhaust chambers, these elements may be supported on the cylinder block using conventional means. The intake and exhaust chambers are formed as elongate, open galleries or chests inside the cylinder block. The turbocharger 110 comprises an exhaust-driven turbine 111 and a compressor 113. Preferably, but not necessarily, the supercharger 114 is mechanically driven, for example by a crankshaft. The output of the compressor 113 is in fluid communication with the intake of the supercharger 114 via the conduit 117. In some aspects, a charge air cooler 115 may be placed in the airflow path between the compressor 113 and the supercharger 114. Although not necessary to this specification, the output of the supercharger 114 may be recirculated to its input through a recirculation channel (not shown in this figure). The output of the supercharger 114 is in fluid communication with the intake chamber via a manifold 120, each branch 121 of which is coupled to a respective elongate opening of the intake chamber by way of a cover 123. The intake of the turbine 111 is in fluid communication with the exhaust chamber via a manifold 130, each branch 131 of which is coupled to a respective elongate opening of the exhaust chamber by way of a cover 133. Alternatively, the configuration of the engine 100 may be such that supercharger 114 is upstream of the turbocharger compressor 113. Although not shown in these figures, the engine 100 may be equipped with a valve-controlled conduit between the exhaust chamber and the supercharger 114 for EGR (exhaust gas recirculation).

Figure 2A:
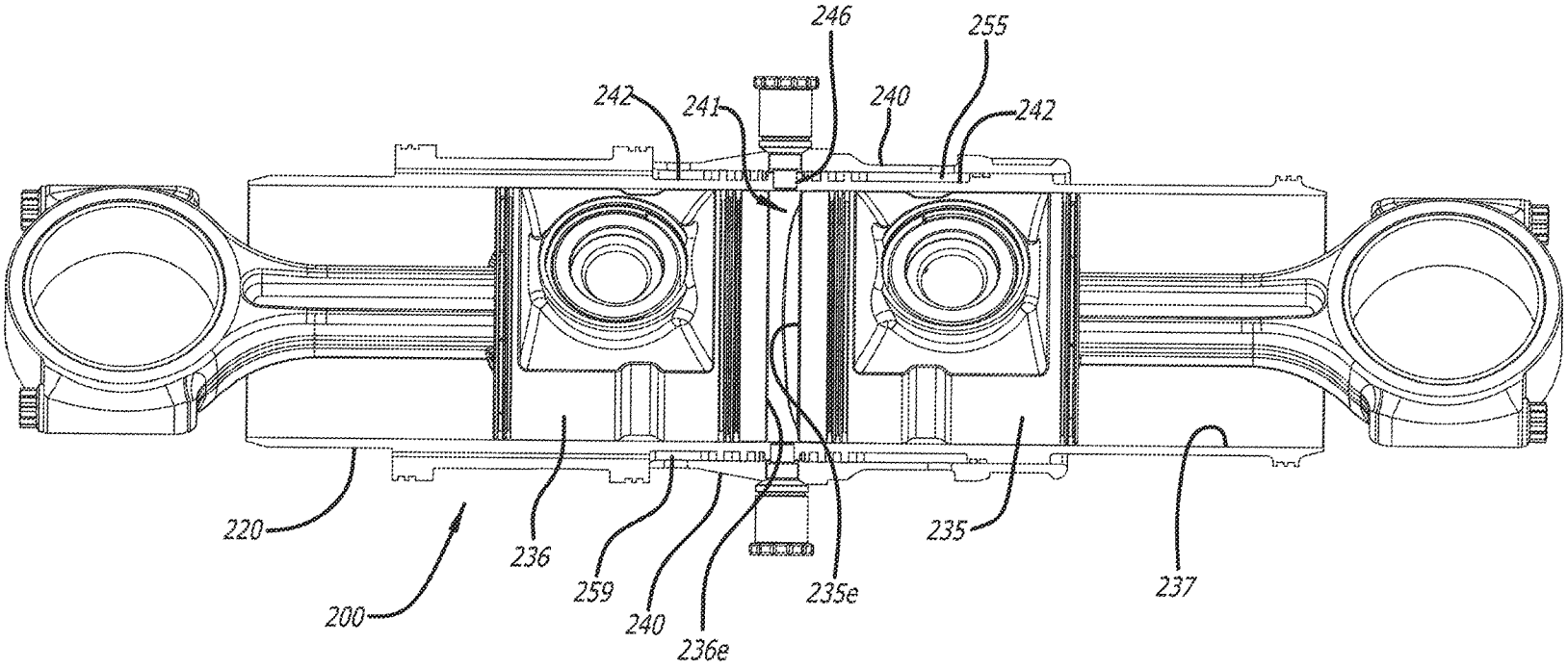
FIGS. 2A and 2B show an exemplary cylinder assembly for use with the opposed-piston engine of FIG. 1.
Figure 2B:
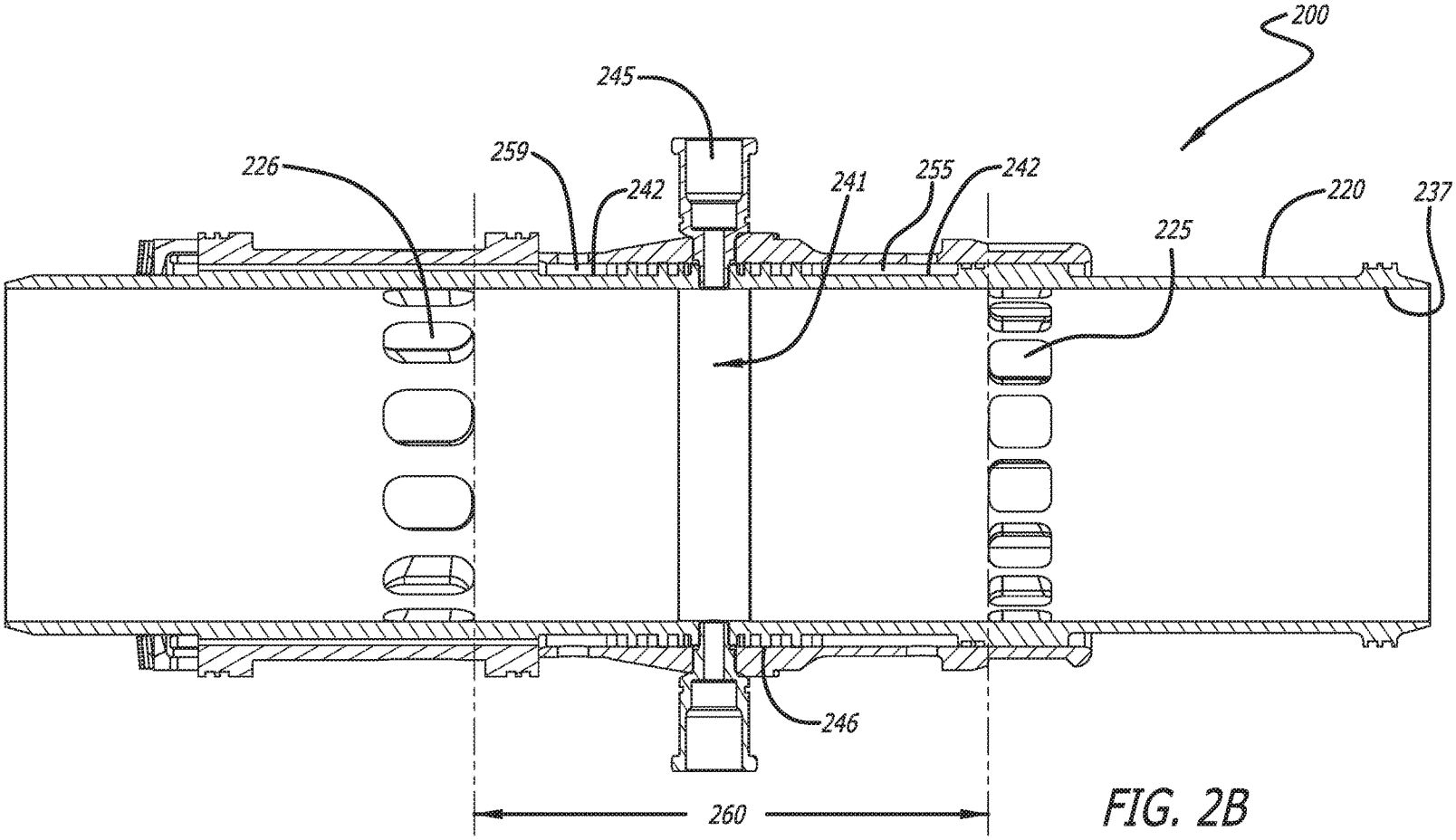
Figure 3A:
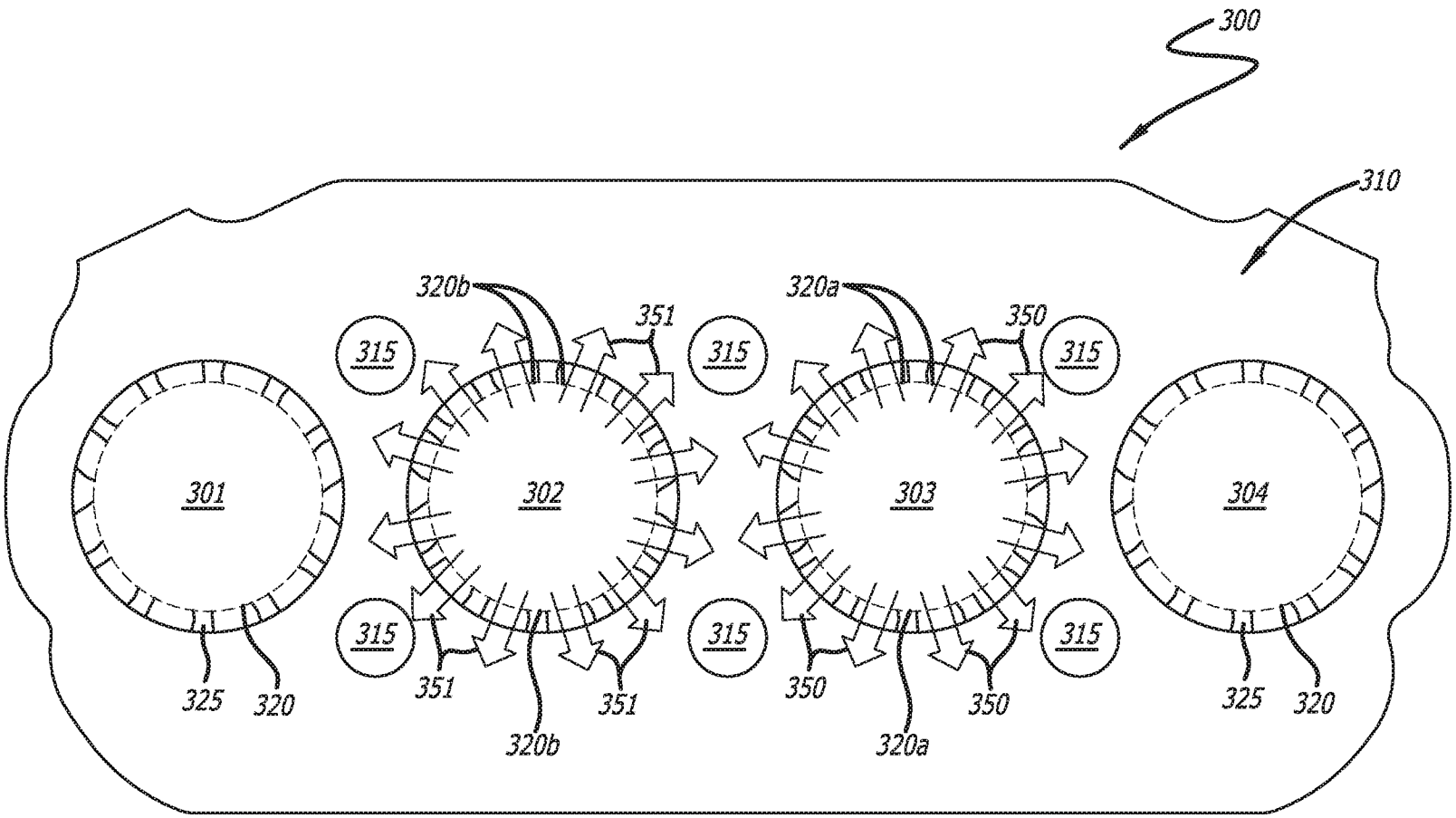
FIG. 3A shows an exemplary exhaust chamber of a 4-cylinder opposed-piston engine.

FIGS. 2A and 2B show an exemplary cylinder assembly 200 for use in an opposed-piston engine. The cylinder assembly 200 includes a liner 220, intake ports 225, exhaust ports 226, an external surface of the liner 242, a compression sleeve 240, and a bore 237. Two pistons 235 and 236 are disposed within the bore 237. The pistons 235 and 236 have end surfaces, 235*e* and 236*e*, respectively, that partially define the combustion chamber 241 when the pistons 235, 236 are at or near their respective top dead center (TDC) positions. The combustion chamber 241 is also partially defined by the cylinder bore 237 in the intermediate portion of the cylinder, between the intake ports 225 and the exhaust ports 226. Located in the intermediate portion, at the periphery of the combustion chamber 241, are openings 246 into which fuel injection components 245 and other engine components can fit. The trapped volume 260 extends beyond the intermediate portion of the cylinder, and at most includes the volume of the bowls in the piston crowns that form the combustion chamber, as well as the cylinder volume from the edge of the intake ports 225 nearest the combustion chamber to the edge of the exhaust ports 226 also nearest the combustion chamber when the ports are closed. Variation in the timing of relative piston motion may cause the exhaust ports to be open while the intake ports are fully closed, or vice versa, so that the trapped volume extends from end surface to end surface and includes the volume of the bowls in the piston crowns. This exemplary cylinder assembly is described in detail in related U.S. patent application Ser. No. 14/675,340.

The compression sleeve 240 is formed to define a generally cylindrical space between itself and the external surface 242 of the liner through which a liquid coolant may flow in an axial direction from near the periphery of the combustion chamber toward intake ports and exhaust ports. The intermediate portion is reinforced by the compression sleeve 240, as described in greater detail in U.S. patent application Ser. No. 14/675,340, and cooling fluid is circulated in the compression sleeve 240 in generally annular spaces 255 and 259. The cooling fluid that circulates in these generally annular spaces 255, 259 flows to other components of the opposed-piston engine, not shown in FIGS. 2A and 2B, that allow for heat to dissipate from the cooling fluid to the surrounding environment, such as a radiator.

Internal combustion engines in general can operate with one, two, three, four, or more than four cylinders. The efficiency of the engine depends on many components in the engine: the air handling system, the cylinders, fuel injection and/or mixing components, feedback systems including sensors and controllers, and the like. Not only do the components and their individual performance impact the efficiency of the engine as a whole, but the arrangement of the components can influence the engine as well. As described with respect to FIG. 1, the engines discussed herein are of the opposed-piston, inline variety. More particularly, the engines described below have an exhaust chamber, or exhaust chest, which is a single volume into which the exhaust ports of all the cylinders communicate, as opposed to an exhaust manifold. That is to say that the exhaust of the cylinders of the engines described herein flows directly into an exhaust chamber, or exhaust chest, without flowing through a conduit, pipe, or large duct. Some advantages to such a configuration are the reduced weight and more compact engine size as compared to an engine with an exhaust manifold, as described with respect to the Jumo 205 family of engines. However, a two-stroke, opposed-piston engine with inline cylinders and an exhaust chamber instead of an exhaust manifold may have the problem of exhaust cross-talk. Such cross-talk happens when an exhaust pressure wave or pulse originates from one cylinder during blowdown and then transmits pressure through the exhaust chest, to the open exhaust ports of any other cylinder in the engine. This situation can occur for various reasons, for example the physical constraints associated with cylinder charging. Cross-talk can be more severe when adjacent cylinders have consecutive blowdown events because the pressure pulse will not have dissipated due to the proximity of the open exhaust ports. Cylinder cross-talk, including backpulsing, is described in greater detail below.

FIG. 3A is a schematic showing a plan view 300 of an exemplary exhaust chamber 310 of an inline, 4-cylinder, opposed-piston engine, including the cylinders. In addition to the exhaust chamber 310, the view shows cylinder 1, cylinder 2, cylinder 3, and cylinder 4 (reference numbers 301, 302, 303, and 304, respectively), and structural posts 315 in the exhaust chamber 310. Each cylinder has exhaust ports 320 and bridges 325 between adjacent ports 320. In this exemplary engine, the firing sequence, or order in which combustion takes place, of the cylinders is cylinder 1, cylinder 3, cylinder 2, and finally cylinder 4. The engine shown is a two-stroke, uniflow-scavenged engine with its crank pins 90° apart to optimize vibrational characteristics of the engine. Because of this, the combustion events in this engine occur in the order listed above every 90 crank angle degrees. As the cylinders fire, one cylinder will have exhaust ports open for blowdown while another cylinder has its exhaust ports open for scavenging; the other two cylinders in the engine will have the ports closed as one of those will be compressing air as the pistons move towards TDC and the other will be in the midst of combustion in this exemplary engine. For example, while combustion occurs in cylinder 1, cylinder 4 is in blowdown, cylinder 2 is scavenging, and cylinder 3 has its ports closed and its pistons are moving towards TDC. 90 degrees later, in cylinder 3 a combustion event occurs, while cylinder 1 is in blowdown, cylinder 4 is scavenging, and the pistons in cylinder 2 are moving towards TDC. One reason for the occurrence of any two cylinders in an inline 4-cylinder engine, as described herein, having open exhaust ports at the same time is because there is a finite time needed for gas (e.g. exhaust and charge air) exchange. While this amount of time, or crank angle, that any two cylinders can simultaneously have open exhaust ports can be minimized, it is impractical for all but the lowest powered applications to completely eliminate that condition to where only one cylinder in the 4-cylinder engine has open exhaust ports at any given time.

In the engine shown in FIG. 3A, there is a concern that a pressure pulse will emanate from cylinder 2 (302) during its blowdown event while cylinder 3 (303) is scavenging. The reason for concern is because when the exhaust ports of cylinder 3 (303) are open for scavenging and charging, the exhaust pressure pulse from the exhaust ports of cylinder 2 may exert a resistive force on the exhaust ports of cylinder 3 (303), thereby reducing the charging efficiency of the engine. This can be referred to as a backpulse or backpulsing. A backpulse is a burst of exhaust gas pressure that causes a reduction in flow mass flow rate or a negative mass flow rate of gas through the intake ports of an adjacent cylinder. Backpulses, or backpulsing, are not a big concern when cylinders 1 (301), cylinder 3 (303), or cylinder 4 (304) undergoes blowdown because the cylinder that has a blowdown event just before each of those cylinders is not adjacent to that particular cylinder. For example, cylinder 1 (301) fires after cylinder 4 (304). During the blowdown event in cylinder 1 (301), the ports of cylinder 2 (302) and cylinder 3 (303) are closed, so a pressure pulse caused by the opening of the exhaust ports of cylinder 1 (301) will not impact cylinders 2 or 3 (302, 303). The distance between cylinder 4 (304) and cylinder 1 (301) is large enough that by the time the pressure pulse generated by the blowdown pressure pulse from cylinder 1 (301) reaches the exhaust ports of cylinder 4 (304), those ports have closed or the open area is very small.

In the view 300 shown in FIG. 3A, exhaust mass 350 leaves cylinder 3 (303) through exhaust ports 320*a*. This exhaust mass 350 is the outflow of gas during scavenging in cylinder 3 (303). Cylinder 2 (302) is shown with a pressure pulse from a blowdown event 351 emanating from exhaust ports 320*b*. The exhaust pressure pulse 351 from cylinder 2 (302) propagates in all directions into the exhaust chamber, and a component of that pressure pulse 351 has a short path to open exhaust ports 320*a* of cylinder 3 (303). As described above, this exhaust pressure pulse 351 may exert pressure on the open exhaust ports 320*a* cylinder 3 (303), and perhaps even cause resistance to charge air moving into cylinder 3 (303), thereby reducing charging efficiency. Charging efficiency is defined as follows:

$$\text{charging efficiency} = \frac{\text{mass of } \textit{deliverd} \text{ air retained}}{((\text{displaced volume})(\text{ambient density}))}$$

When evaluating charging efficiency at the time of port closure, the "ambient density" is the ambient density of air, the "displaced volume" is the trapped swept volume, and the "mass of the delivered air retained" is just that. The engine's charging efficiency is reduced because the exhaust pressure pulse 351 from cylinder 2 (302) arrives at the open ports of cylinder 3 (303), causing resistance which needs to be overcome during scavenging. With this resistance, the engine's air flow system (e.g., supercharger, turbocharger, other compression pumps) must work harder to charge each cylinder with the same amount of fresh air as it would without the backpulses.

Figure 3B:
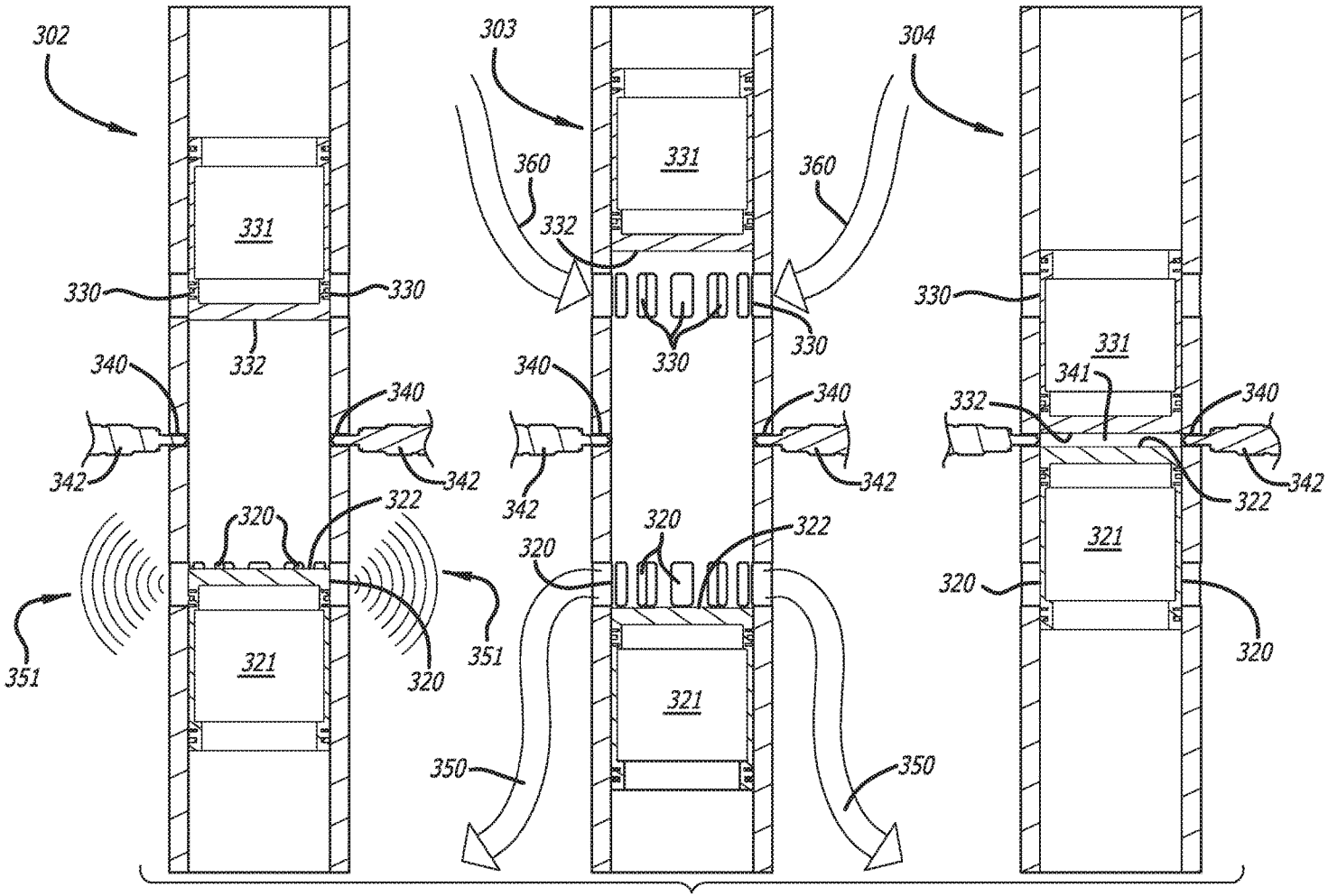
FIG. 3B shows exemplary cylinders in the exhaust chamber shown in FIG. 3A.

FIG. 3B shows three of the four cylinders in a 4-cylinder opposed-piston engine. In FIG. 3B, cylinder 2 (302) is on the left, cylinder 3 (303) is in the middle, and cylinder 4 (304) is on the right. In FIG. 3B, cylinder 2 (302) is undergoing blowdown, cylinder 3 (303) is undergoing scavenging, and cylinder 4 (304) is undergoing combustion. In each cylinder, the intake ports 330, the exhaust ports 320, fuel injection ports 340, intake piston 331, exhaust piston 321, intake piston end surface 332, and exhaust piston end surface 322 are shown. In cylinder 2 (302), which is undergoing blowdown, the exhaust pressure pulse 351 emanates from the exhaust ports 320. This exhaust pressure pulse 351 is created when pressure in the cylinder 302, which is very high due to the combustion event, is exposed to the low pressure in the exhaust chamber. This exposure happens as the exhaust ports open at the beginning of a blowdown event. In cylinder 3 (303), the airflow of charge air in 360 and exhaust mass out 350 is shown. Cylinder 4 (304) is shown with the fuel injector nozzles 342 and the combustion chamber 341. The combustion chamber 341 is formed between the end surfaces 322, 332 of the pistons 321, 331. What is depicted in FIG. 3B are exemplary flow paths of exhaust mass 350, as well as the direction of exhaust blowdown pressure pulses 351, between adjacent cylinders with consecutive blowdown events, cylinders 2 and 3 (302, 303), as well as charge air 360 into the intake ports 330 of cylinder 3 (303). FIG. 3B allows for visualization of the exhaust pressure pulse 351 that originates from cylinder 2 (302) at the start of its blowdown event and moves toward the exhaust ports 320 of cylinder 3 (303).

In a 4-cylinder, uniflow-scavenged, opposed-piston engine with an open exhaust chamber, or open exhaust chest, minimization of exhaust cross-talk between cylinders can be achieved by inserting a wall or other obstructing feature between adjacent cylinders that undergo blowdown successively or consecutively.

Figure 4A:
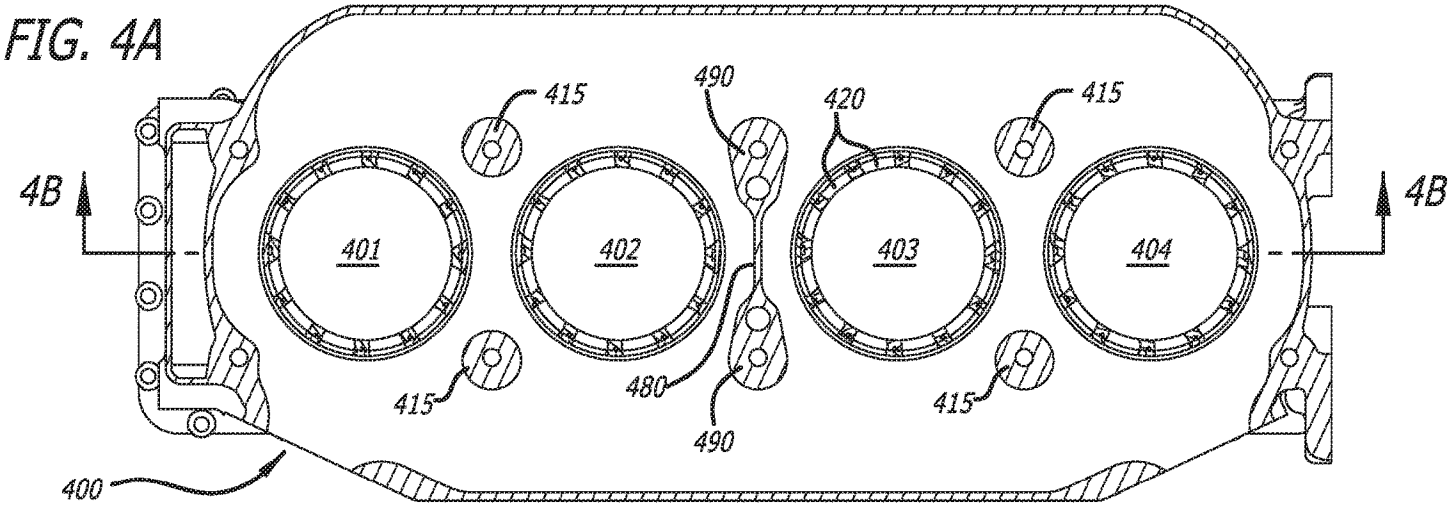
FIG. 4A shows an exemplary configuration for an opposed-piston engine exhaust chest according to some implementations.

FIG. 4A shows a schematic of a cross-sectional plan view of an exhaust chamber 400, or exhaust chest, cut through the exhaust ports, looking from exhaust TDC towards exhaust BDC of the cylinders for an inline 4-cylinder opposed-piston engine. In the engine, cylinders 2 and 3 (402, 403) are fired consecutively, as the firing order is cylinder 1 (401), cylinder 3 (403), cylinder 2 (402), then cylinder 4 (404), with the blowdown events following the same order. A wall 480 is present in the exhaust chamber 400 between cylinders 2 and 3, joining two structural posts 490. Other structural posts 415 can be present in the exhaust chamber 400. The wall 480 can be the height of the exhaust chamber 400, such that the wall 480 spans the distance from the floor 410 of the chamber to the interior ceiling 411 of the chamber. In place of the wall 480, other features can be included in the exhaust chamber which cause the exhaust pressure pulse from the ports 420 of cylinder 2 (402) to take a longer path before reaching the ports of cylinder 3 (403). In fact, it is most desirable that the wall 480 or other obstructing feature create a path such that by the time the exhaust pressure pulse from cylinder 2 (402) reaches the exhaust ports 420 of cylinder 3 (403), those ports are closed. In a 4-cylinder engine with the firing and blowdown event order of cylinder 1, cylinder 3, cylinder 2, cylinder 4, by the time the exhaust pressure pulse from cylinder 1 reaches cylinder 3, the exhaust ports will be closed, and an exhaust pressure pulse from cylinder 4 will reach cylinder 1 when those exhaust ports are closed. Because of this, a wall or other obstructing feature may not be needed anywhere else in the exhaust chamber except between adjacent cylinders with consecutive blowdown events, specifically cylinders 2 and 3.

Figure 4B:
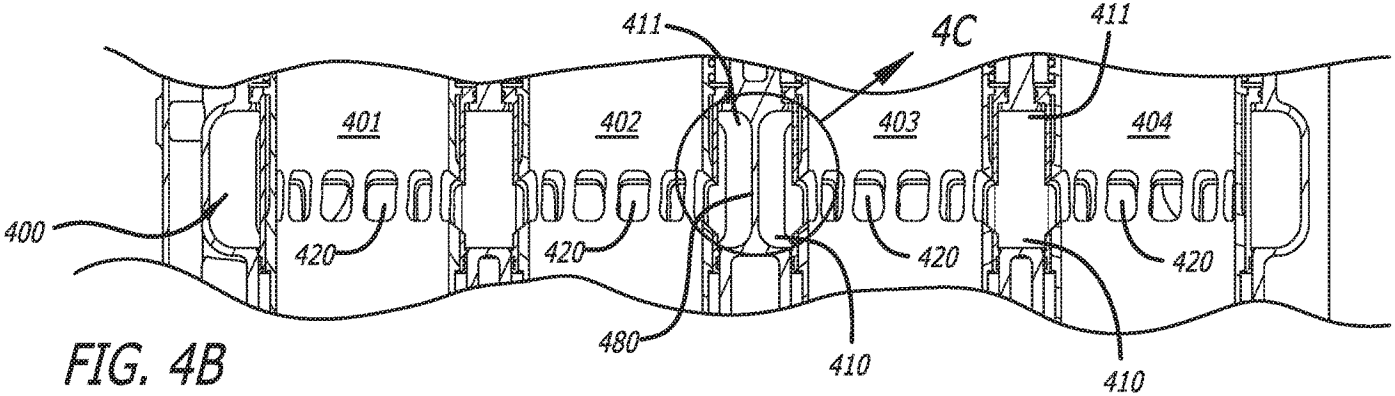
FIG. 4B shows another view of the exemplary configuration for an opposed-piston engine exhaust chest seen in FIG. 4A.
Figure 4C:
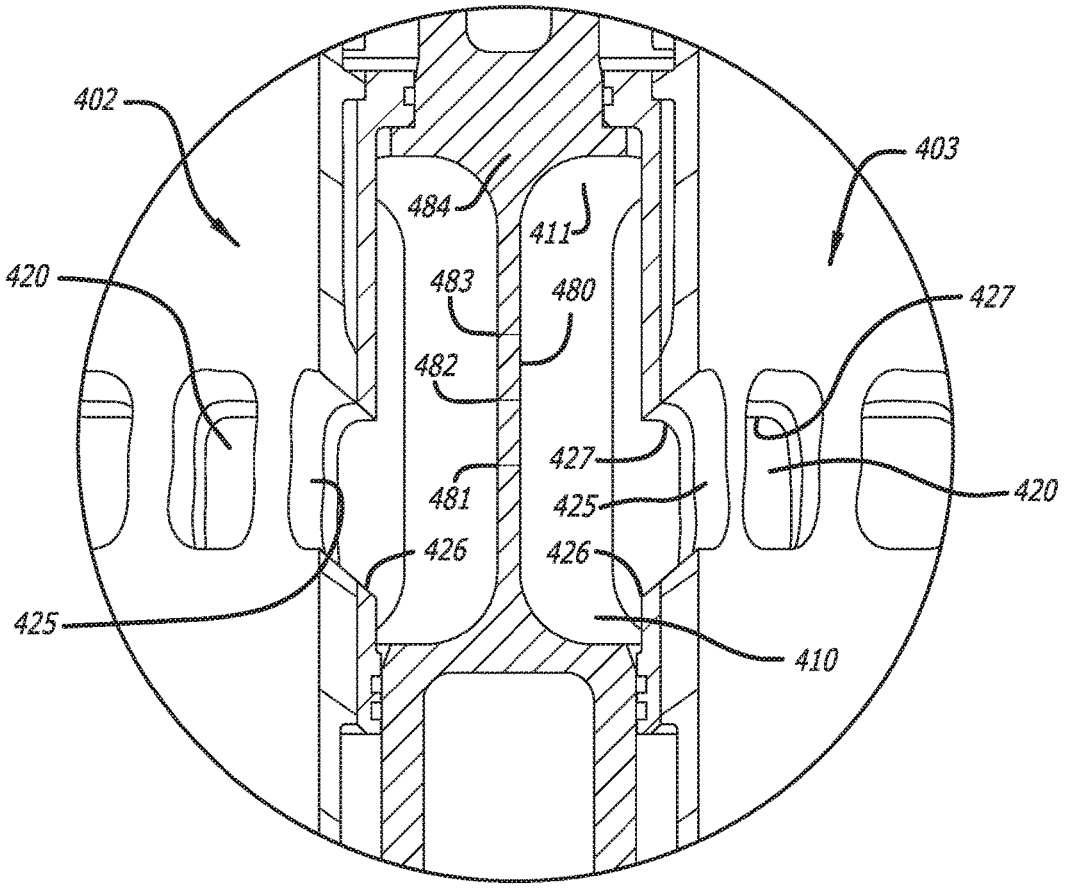
FIG. 4C is an enlarged view of a portion of the exemplary configuration for an opposed-piston engine exhaust chest of FIGS. 4A and 4B in which a wall between the middle cylinders is shown in greater detail.

FIG. 4B shows a cross-sectional view of the same exhaust chest and cylinders shown in FIG. 4A, but in elevation as opposed to in plan view, taken along the line 4B. The wall 480 and its surroundings, as indicated by the circle 4C, are shown in greater detail in FIG. 4C. In FIG. 4C, the wall 480 is shown between cylinders 2 and 3 (402, 403). Though the wall 480 is shown reaching from the floor 410 of the exhaust chest 400 to the ceiling 411 of the chest, so that it has a height indicated by the dashed line 484, the wall 480 may be a partial wall. In some implementations, the wall 480 may have a height that is approximately half of the depth of the exhaust chamber or chest 400; such as height is shown in FIG. 4C by the dotted line 482. Alternatively, or additionally, the wall 480 may have a height that reaches approximately to the top 427 of an opening in the cylinder to the exhaust chamber 400; this height is shown in FIG. 4C by the dotted line 483. Each opening in the cylinder from which pressure pulses originate in the exhaust chamber 400 can have a top 427, a bottom 426, and can be separated from its corresponding port 420 by a thickness of the cylinder wall 425. The top 427 of each opening into the exhaust chamber 400 can be located at approximately the top of its corresponding port 420, but in some implementations, the top 427 of each opening can be closer to the combustion chamber or further away from the combustion chamber than the top of the corresponding port 420. The wall 480 may have multiple heights along its length, such that part of the wall can reach a taller height 483, a medium height 482, a low height 481, or all the way to the ceiling 484.

In some implementations, the wall or other feature need not span the interior floor to ceiling of the exhaust chamber to create a flow path that prevents the pressure pulse generated by the pressure release of cylinder 2 from reaching the ports of cylinder 3 while open. The wall can reach from the floor to a height at least equal to the height of the openings through which exhaust leaves the cylinder bore (e.g., exhaust ports), but not high enough to reach the ceiling of the exhaust chamber or chest. The wall can reach from the floor to a height at least equal to the height of the openings from which pressure pulses generated by blowdown events emanate. Though the wall is described as being between cylinders 2 and 3, a wall or other obstructing feature could be inserted between any adjacent cylinders with consecutive blowdown events in an opposed-piston engine.

A wall, or other feature, between adjacent cylinders with consecutive blowdown events, such as cylinders 2 and 3 in an inline 4-cylinder engine as described above, can be located equidistant between the cylinders. Alternatively, a wall can be located closer to the cylinder that has the first blowdown event or closer to the cylinder that has the second blowdown event in a pair of adjacent cylinders with consecutive blowdown events. The size and configuration of a wall, or other feature, can be optimized for the dimensions of the exhaust chamber or chest. A wall can have a length that is equal to half the length of the exhaust chamber, as shown in FIG. 4A. In some implementations, the wall can have a length that is greater than half the length of the exhaust chamber but not so long that the barrier wall contacts the walls of the exhaust chamber in a continuous manner. When a wall between two adjacent cylinders that have consecutive blowdown events reaches from the floor to the interior ceiling of the exhaust chamber, the wall may have one or more openings in it. Alternatively, when a wall between two adjacent cylinders is a partial wall (e.g., does not reach all the way to the ceiling or all the way to the floor), the wall may have a length that is equal to the length of the exhaust chamber. The thickness of a wall, or other feature, between adjacent cylinders with consecutive blowdown events can be uniform along the length and/or height of the wall. Alternatively, the thickness of a wall can vary along the length of the wall and/or can vary along the height of the wall. For example, a wall can have a constant thickness along its length, but can taper in thickness from the base of the wall to the topmost height of the wall.

The wall, its ends, or portions of a feature present instead of a wall, can be advantageously used for transferring heat away from the exhaust chamber, such as by being a conduit or channel for coolant flow. In some implementations, a wall is present in the exhaust chamber of a 4-cylinder, opposed-piston engine, that impedes exhaust flow and pressure pulse communication between two adjacent cylinders with consecutive blowdown events. This wall can be continuous from the floor to the ceiling of the exhaust chamber, and the ends of the wall (490 in FIG. 4A) can terminate in spaces through which coolant flows when the engine is in use.

In some engines with an exhaust chamber instead of an exhaust manifold, a wall or obstructing feature is inserted between the exhaust ports of cylinders with consecutive blowdown events, and the cylinders themselves are optimized to influence the duration of an overlap in exhaust port opening for the cylinders. This type of optimization of the cylinders themselves, particularly the port openings in the cylinders, is described in greater detail below.

EXAMPLE 1

In this example, computational fluid dynamics simulations were run on an inline, 4-cylinder, uniflow-scavenged, opposed-piston engine under two different cylinder types. The first type of cylinder had intake and exhaust ports optimized for an inline, 3-cylinder engine. In an inline, 3-cylinder engine in which the crank pins are equally spaced, there is one combustion event, and a corresponding blow down event, every 120 degrees of crank angle. The cylinders whose performance is shown in the plot of FIG. 5A were designed for such a 3-cylinder engine, in which the exhaust events (e.g., blowdown, scavenging) of one cylinder will not impact or be influenced by those of an adjacent cylinder when adjacent cylinders have consecutive blowdown events.

The second type of cylinder had intake and exhaust ports reduced in size compared to the first cylinder type. As described above, it may not be practical to optimize cylinders in a 4-cylinder engine such that the exhaust ports of only one cylinder are open at any given time.

In the simulations, the exhaust chamber, or exhaust chest, had the same dimensions, the amount of fuel used for combustion was the same, and the configuration of the other parts of the cylinder and engine remained the same. FIGS. 5A and 5B show crank angle after minimum volume of cylinder 1 along the abscissa (i.e. x-axis, corresponding to the units degrees AMV (after minimum volume)) and open area of all of the ports in the ordinate direction (i.e. y-axis). 0 crank angle degrees (not shown) on the plots coincides with the minimum volume of cylinder 1. When a cylinder is undergoing blowdown, the exhaust ports are open while the intake ports are still closed. On the plots, this is when the exhaust ports have non-zero values for open area while the intake ports have an open area value of zero. As discussed above, when blowdown of a cylinder overlaps with when its neighboring cylinder, the cylinder just adjacent to it, has open exhaust ports, then there is the possibility for exhaust cross-talk. In the simulations, the firing order, and corresponding blown down order, of the cylinders was cylinder 1, cylinder 3, cylinder 2, and cylinder 4. Thus, the blowdown of cylinder 2 affecting cylinder 3 was the biggest concern. The metric that was compared in the plots was the overlapping portion of the exhaust port area trace indicating open ports.

Figure 5A:
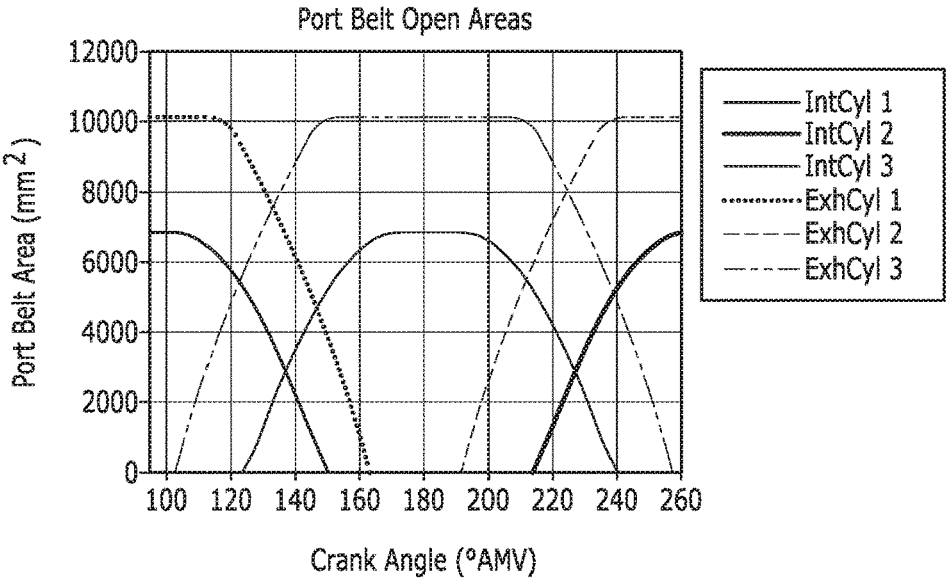
FIG. 5A is an exemplary plot of port open area versus crank angle for a set of cylinders that are optimized for an inline 3-cylinder engine while used in an inline 4-cylinder engine.
Figure 5B:
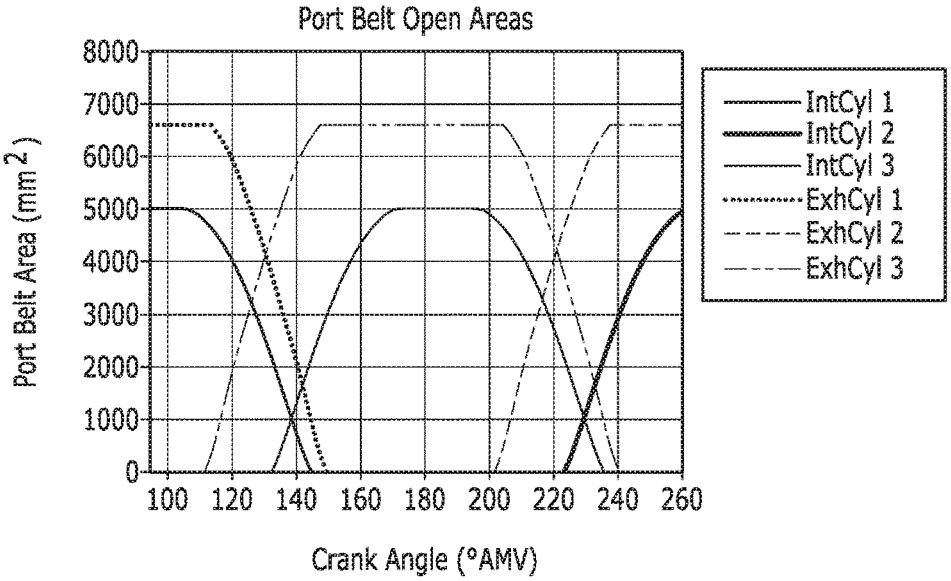
FIG. 5B shows a plot of port open area versus crank angle for a set of cylinders with inlet and exhaust ports as described herein.

FIG. 5A is a plot of open port area as a function of crank angle for a 4-cylinder engine in which the cylinders were designed for an inline 3-cylinder engine, the first types of cylinder discussed above. The overlap between the open exhaust ports of cylinder 3 and cylinder 2 shown in FIG. 5A was about 60 crank angle degrees. For this simulation, the intake ports were open for scavenging and charging for approximately 115 crank angle degrees. The dimensions of the first type of cylinders were: bore diameter of 130 mm; swept volume of 3.58 liters; and trapped volume of 2.44 liters.

FIG. 5B shows a plot of open port area as a function of crank angle for an engine configuration with port height reduced, compared to those shown in FIG. 5A. The amount of overlap, in crank angle, of when cylinders with consecutive blowdown events had open exhaust ports was about 38 crank angle degrees in this simulation, as shown in FIG. 5B. That means that the ports for cylinders 2 and 3 overlapped by about 22 crank angle degrees less in the engine configuration yielding the plot shown in FIG. 5B, and correspondingly the exhaust events for cylinder 2 impacted cylinder 3 to a lesser degree. The dimensions of cylinders used in the simulation that resulted in the plot shown in FIG. 5B were: bore diameter of 130 mm; swept volume of 3.58 liters; and trapped volume of 2.93 liters.

EXAMPLE 2

Figure 5C:
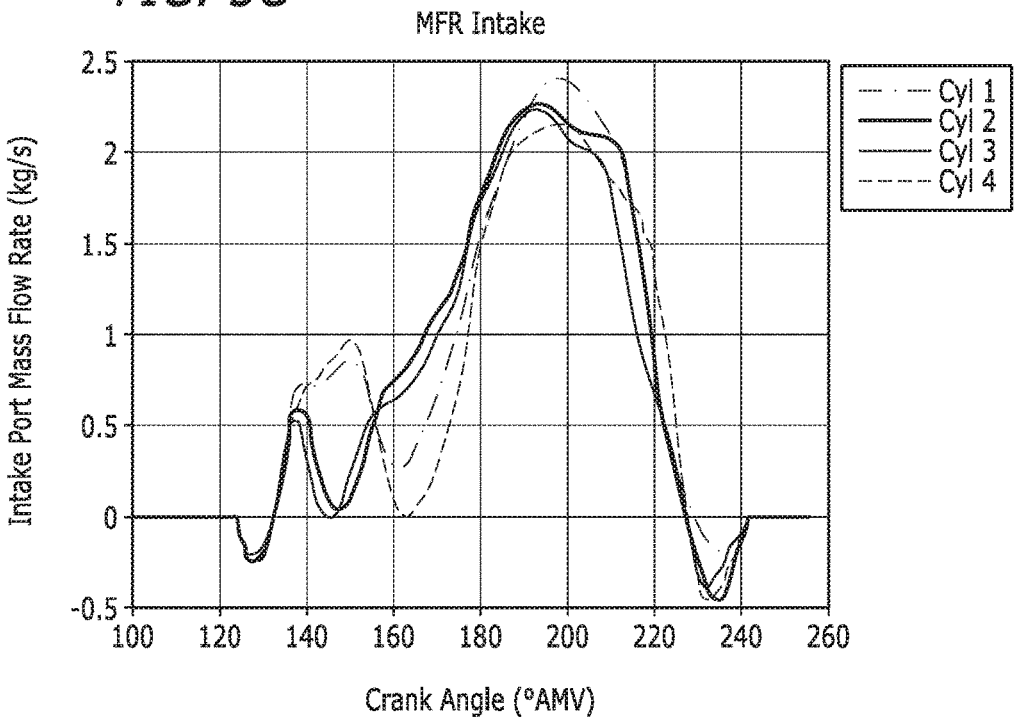
FIG. 5C shows a plot of mass flow rate through the intake ports of cylinders in an exemplary inline, 4-cylinder, opposed-piston engine.
Figure 5D:
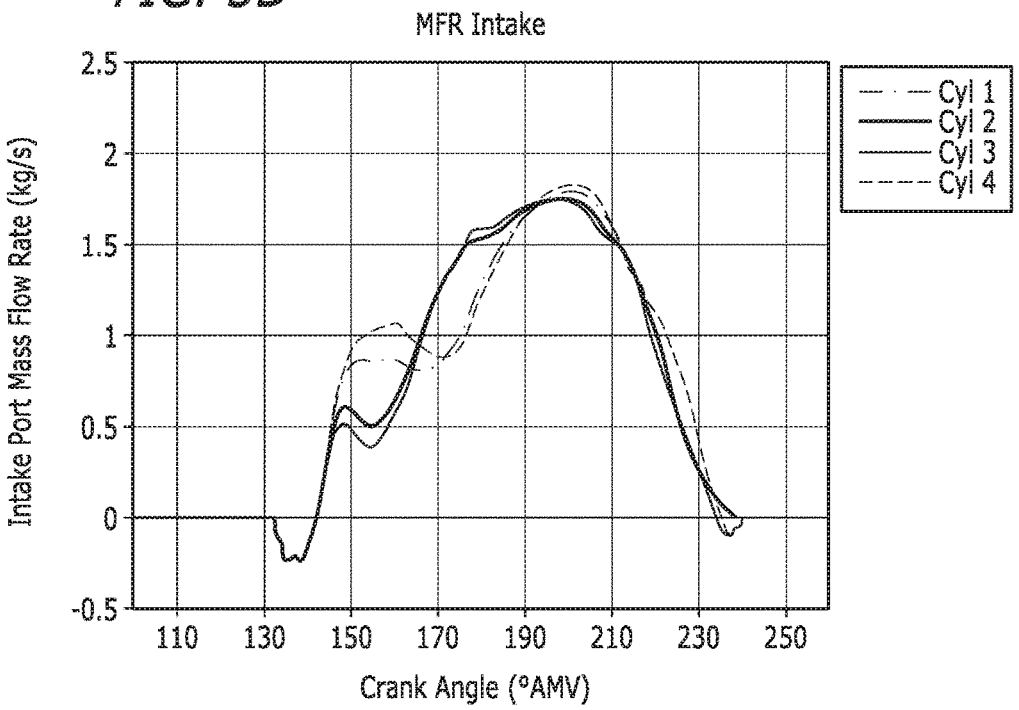
FIG. 5D shows a plot of mass flow rate through the intake ports of cylinders in an exemplary inline, 4-cylinder, opposed-piston engine in which the intake and exhaust ports of the cylinders are smaller than those of the engine yielding the plot shown in FIG. 5C.

FIG. 5C shows a plot of mass flow rate in intake ports for exemplary cylinders in a 4-cylinder, inline, opposed-piston engine. The engine that generated the simulation data shown in FIGS. 5C and 5D has a firing order of cylinder 1, cylinder 3, cylinder 2, cylinder 4, like the exemplary engines that generated the data shown in FIGS. 5A and 5B. The plots for each cylinder in the 4-cylinder engine for which data are shown in FIGS. 5C and 5D are overlaid, for easy comparison. The engine used in this simulation experienced back-pulsing at around 230 crank angle degrees. In this area of the plot, the mass flow rate through the intake ports had a negative value, indicating that gas was actually pushed out of the intake ports into the intake chamber (i.e., intake chest). As discussed above, this caused a loss in charging efficiency and increased the amount of pumping work required by the air system in the engine. The simulated engine that produced that data had the following cylinder dimensions: bore diameter of 130 mm; swept volume of 3.58 liters; and trapped volume of 2.44 liters.

FIG. 5D shows a plot of mass flow rate in intake ports for exemplary cylinders in a 4-cylinder, inline, opposed-piston engine with the same firing sequence used in the simulated engine that yielded the data shown in FIG. 5C. The dimensions of the cylinders used in the simulation that yielded the data shown in FIG. 5D are: bore diameter of 130 mm; swept volume of 3.58 liters; and trapped volume of 2.93 liters. In FIG. 5D, the mass flow rate through the intake ports was minimally negative at about 230 crank angle degrees. Comparing the plots shown in FIGS. 5C and 5D, the charging efficiency of the engine with smaller intake and exhaust ports was greater than that of the engine that yielded the data shown in FIG. 5C.

In some implementations of the engine configurations described herein, in an inline, 2-stroke, uniflow-scavenged, opposed-piston engine with an open exhaust chamber, or exhaust chest, in which two or more cylinders simultaneously have open exhaust ports, the simultaneously open exhaust ports are both open for 65 crank angle degrees or less, such as for about 60 crank angle degrees or less, including for about 40 crank angle degrees. In an inline, 2-stroke, uniflow-scavenged, opposed-piston engine with an open exhaust chamber, or exhaust chest, in which two or more cylinders simultaneously have open exhaust ports, the simultaneously open exhaust ports can be both open for less than 40 crank angle degrees, such as for 38 crank angle degrees, or 35 crank angle degrees. For such engines, the intake ports for each cylinder during a rotation of the engine crank shaft can be open for 115 crank angle degrees or less, such as for 100 crank angle degrees, or less than 100 crank angle degrees.

Though the engine configurations described herein are discussed with respect to two-stroke, uniflow-scavenged, opposed-piston engines, the cylinders, exhaust chests, and engine configurations described can be applied to any two-stroke engine with exhaust ports. Further, though the cylinders are shown in the figures as being equidistant and evenly spaced, in some implementations, the cylinder to cylinder spacing can be non-uniform.

The scope of patent protection afforded the novel tools and methods described and illustrated herein may suitably comprise, consist of, or consist essentially of the elements of a cylinder for an opposed-piston engine with an exhaust chamber (e.g. open exhaust chest) with one or more walls between the exhaust ports of adjacent cylinders that have consecutive blowdown events. Additionally, the scope of the novel opposed-piston engine configurations described and illustrated herein may suitably comprise, consist of, or consist essentially of a cylinder for an inline, 2-stroke, uniflow-scavenged, opposed-piston engine with an open exhaust chamber, or exhaust chest, in which two or more cylinders simultaneously have open exhaust ports for 65 degrees of crank angle or less. Further, the novel tools and methods disclosed and illustrated herein may suitably be practiced in the absence of any element or step which is not specifically disclosed in the specification, illustrated in the drawings, and/or exemplified in the embodiments of this application. Moreover, although the invention has been described with reference to the presently preferred embodiment, it should be understood that various modifications can be made without departing from the spirit of the invention. Accordingly, the invention is limited only by the following claims. The novel opposed-piston engine configurations disclosed and illustrated herein may suitably be practiced in the absence of any element which is not specifically disclosed in the specification, illustrated in the drawings, and/or exemplified in the embodiments of this application.

The invention claimed is:

1. A uniflow-scavenged, opposed-piston engine comprising:

two or more cylinders, wherein at least two of the two or more cylinders are adjacent and have consecutive blowdown events, each of the two or more cylinders comprising:

a cylinder wall with an interior surface defining a bore centered on a longitudinal axis of the cylinder, the bore having a first diameter relative to the longitudinal axis; and intake and exhaust ports formed in the cylinder wall near respective opposite ends of the cylinder;

an exhaust chamber, in which the exhaust ports of each of the two or more cylinders are situated and that receives all exhaust from each of the two or more cylinders; and a wall with ends in the exhaust chamber, between the at least two cylinders of the two or more cylinders that are adjacent and have consecutive blowdown events, in which the exhaust chamber has an interior floor and an interior ceiling, and further wherein the wall extends from the interior floor to a height at least equal to the height of openings through which exhaust gas pulses emanate, and the wall does not reach the interior ceiling of the exhaust chamber.

2. The opposed-piston engine of claim 1, further comprising a crankshaft that rotates through 360 crank angle degrees during each cycle of engine operation, wherein at any given time during a cycle of engine operation, any two of the two or more cylinders simultaneously have open exhaust ports, and the simultaneously open exhaust ports are open simultaneously for 65 crank angle degrees or less.

3. The opposed-piston engine of claim 2, wherein the simultaneously open exhaust ports are open simultaneously for about 40 crank angle degrees or less.

4. The opposed-piston engine of claim 2, wherein the simultaneously open exhaust ports are open simultaneously for about 38 crank angle degrees or less.

5. A uniflow-scavenged, opposed-piston engine comprising:

two or more cylinders arranged inline in a cylinder block, wherein at least two of the two or more cylinders are adjacent and have consecutive blowdown events, each of the two or more cylinders comprising:

a cylinder wall with an interior surface defining a bore centered on a longitudinal axis of the cylinder, the bore having a first diameter relative to the longitudinal axis; and intake and exhaust ports formed in the cylinder wall near respective opposite ends of the cylinder;

an exhaust chamber, in which the exhaust ports of each of the two or more cylinders are situated and that receives all exhaust from each of the two or more cylinders; and a wall with ends in the exhaust chamber, between the at least two of the two or more cylinders that are adjacent and have consecutive blowdown events, in which a length of the wall is terminated by a post on each end of the wall and coolant flows through at least each end of the wall.

6. The opposed-piston engine of claim 5, further comprising a crankshaft that rotates through 360 crank angle degrees during each cycle of engine operation, wherein at any given time during a cycle of engine operation, any two of the two or more cylinders simultaneously have open exhaust ports, and the simultaneously open exhaust ports are open simultaneously for 65 crank angle degrees or less.

7. The opposed-piston engine of claim 6, wherein the simultaneously open exhaust ports are open simultaneously for 40 crank angle degrees or less.

8. The opposed-piston engine of claim 6, wherein the simultaneously open exhaust ports are open simultaneously for 38 crank angle degrees or less.

9. A method of operating a two-stroke, uniflow-scavenged, opposed-piston engine, the engine comprising:

four cylinders in an in-line array, each cylinder in the in-line array of four cylinders comprising an exhaust port;

a pair of pistons in each cylinder in the in-line array of four cylinders, in which each pair of pistons comprises an intake piston and an exhaust piston;

an engine block with an exhaust chest configured to receive all exhaust gas discharged from the four cylinders;

in which the four cylinders in the in-line array are designated cylinder 1, cylinder 2, cylinder 3, and cylinder 4 consecutively from a first end of the in-line array to a second end of the in-line array;

the method comprising firing the four cylinders in a firing sequence in which cylinder 1 is fired first, cylinder 3 is fired second, cylinder 2 is fired third, and cylinder 4 is fired last, such that blowdown event order for the four cylinders is cylinder 1, cylinder 3, cylinder 2, then cylinder 4, in which the exhaust chest comprises a wall between cylinder 2 and cylinder 3.

10. The method of claim 9, wherein the wall between cylinder 2 and cylinder 3 comprises a wall with ends that terminate in spaces through which coolant flows when the engine is in use.

11. The method of claim 10, further comprising flowing coolant through the ends of the wall between cylinder 2 and cylinder 3 when the engine is in use.

12. The method of claim 9, wherein an overlap in crank angle between open exhaust ports of cylinder 3 and cylinder 2 is 65 crank angle degrees or less during operation of the engine.

* * * * *